US005088545A

United States Patent [19]

Corbett

[11] Patent Number: 5,088,545

[45] Date of Patent: Feb. 18, 1992

[54] EVAPORABLE FOAM PATTERN FOR USE IN CASTING A METAL ENGINE BLOCK HAVING A LOOP CHARGE SYSTEM

[75] Inventor: William D. Corbett, Fond du Lac, Wis.

[73] Assignee: Brunswick Corporation, Skokie, Ill.

[21] Appl. No.: 599,704

[22] Filed: Oct. 18, 1990

[51] Int. Cl.[5] ..... B22C 9/04

[52] U.S. Cl. ..... 164/246; 164/34; 164/45

[58] Field of Search ..... 164/34, 35, 45, 235, 164/246, 249

[56] References Cited

U.S. PATENT DOCUMENTS

| | | | |
|---|---|---|---|
| 4,632,169 | 12/1986 | Osborn et al. | 164/45 |
| 4,640,333 | 2/1987 | Martin et al. | 164/246 |
| 4,657,063 | 4/1987 | Morris | 164/45 |
| 4,777,997 | 10/1988 | Corbett | 164/246 |
| 4,802,447 | 1/1989 | Corbett | 164/45 |
| 4,883,110 | 11/1989 | Morgan et al. | 164/249 |
| 4,907,638 | 3/1990 | Hubbell et al. | 164/45 |
| 4,951,733 | 8/1990 | Kusche et al. | 164/246 |

FOREIGN PATENT DOCUMENTS

| | | |
|---|---|---|
| 62-282744 | 12/1987 | Japan . |
| 62-282745 | 12/1987 | Japan . |
| 62-282746 | 12/1987 | Japan . |
| 62-282747 | 12/1987 | Japan . |
| 62-282763 | 12/1987 | Japan . |

OTHER PUBLICATIONS

"Evaporative Foam Casting Technology II Program", Nov. 1986.

*Primary Examiner*—Kuang Y. Lin

*Attorney, Agent, or Firm*—Andrus, Sceales, Starke & Sawall

[57] ABSTRACT

An evaporable foam pattern for casting a metal block for a two-cycle engine. The pattern includes a first pattern section formed of a polymeric material and defining at least one cylinder. The first pattern section has a plurality of elongated slots each of which extends through the section and communicate with a cylinder. Each slot is bordered by an external planar surface. The pattern also includes a group of second pattern sections each formed of polymeric material and having an inner portion extending within a slot and having a peripheral flange disposed in abutting relation with the surface bordering the slot. The abutting surfaces are joined together by an adhesive.

10 Claims, 1 Drawing Sheet

EVAPORABLE FOAM PATTERN FOR USE IN CASTING A METAL ENGINE BLOCK HAVING A LOOP CHARGE SYSTEM

BACKGROUND OF THE INVENTION

A typical, two-cycle, internal combustion engine includes a cast metal block defining a plurality of cylinders. With a loop charge system, a group of transfer ports or passages are associated with each cylinder and extend from the crankcase end of the block to the upper end of the respective cylinder. In operation of the piston, combustible charges are drawn upwardly from the crankcase through the transfer ports to the head end of the cylinder. The charges converge below the spark plug and the confluent charge is compressed by the upward stroke of the piston. After ignition by the spark, waste gases of combustion are expelled through the cylinder exhaust port with the downward power stroke of the pistons.

The conventional two-cycle engine block having a loop charge system is cast with a group of elongated slots, each of which extends through the wall of the block and communicates with a cylinder. Separately cast port covers are connected to the block and enclose the slots. The inner surface of each port cover defines the outer wall of the respective transfer port.

To assemble the port covers with the cast block, the mating surfaces on the covers and block must be machined, and holes are drilled in the covers and block and tapped. The mating surfaces are then gasketed and secured together by bolts. With a two cylinder engine, each cylinder has three transfer ports so that a total of six port covers must be assembled to the block, requiring approximately ninety separate components, such as bolts, gaskets, nuts, and the like. Thus, this assembly procedure involves a substantial labor and material cost and is a major contribution to the overall cost of the engine. Further, in order to provide adequate gasketing, the mating surfaces of the port covers and block must have a substantial width and this increases the overall weight of the engine.

Evaporable foam patterns made of a polymeric material, such as polystyrene, have been used in the past to cast metal components of internal combustion engines. In the evaporable foam casting process, a pattern is fabricated from the polymeric material and has a configuration conforming to the metal part to be cast. The pattern is then placed in a mold and the area around the pattern, as well as the cavities in the pattern are filled with an unbonded flowable material, such as sand. Molten metal is introduced to the pattern via a sprue, and the heat of the molten metal will vaporize the foam material, with the vapor being entrapped within the interstices of the foam, while the molten metal will occupy the void created by vaporization of the foam pattern to provide a cast metal part having a configuration conforming to the configuration of the pattern.

SUMMARY OF THE INVENTION

The invention is directed to an evaporable foam pattern to be used in casting a metal block for a two-cycle engine having a loop charge system. The pattern includes a block pattern section formed of an evaporable foam polymeric material, such as polystyrene, which defines a plurality of cylinders. A plurality of elongated slots extend through the wall of the block pattern section and communicate with each cylinder. In normal practice, three slots are associated with each cylinder, conforming to the number of transfer ports in the assembled cast engine.

Each slot is elongated in a direction parallel to the axis of the cylinder and each slot is bordered by a flat peripheral surface.

The pattern also includes a series of cover port pattern sections, also formed of a polymeric material. Each port cover section includes an inner portion that is located within a slot and an outer flange which abuts the peripheral surface bordering the slot. The two abutting surfaces are joined together by an adhesive of the type used in evaporable foam casting processes.

The inner surface of each port cover section is spaced outwardly from the respective cylinder wall and forms the outer wall of a transfer port in the cast engine.

To cast the engine, the assembled pattern is in a mold which is filled with an unbonded, flowable, finely divided material, such as sand, and the sand not only surrounds the pattern but will also fill the cavities in the pattern. An evaporable foam sprue is connected to the pattern and as the molten metal is fed through the sprue, it will vaporize the pattern with the vapor being entrapped within the interstices of the sand, while the molten metal will fill the void created by vaporization of the foam to provide a cast engine block conforming in configuration to the evaporable foam pattern.

Through use of the evaporable foam pattern of the invention, the port covers are cast integrally with the engine block, thus eliminating the labor and cost of machining mating surfaces on the port covers and engine block, drilling and tapping holes, and assembling the separate covers to the engine block, as required in the past.

As a further advantage, the weight of the block can be reduced because it is not necessary to utilize surfaces of increased width in order to accommodate gasketing. Further, the elimination of bolts, bosses, and other components further reduces the overall weight of the block.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
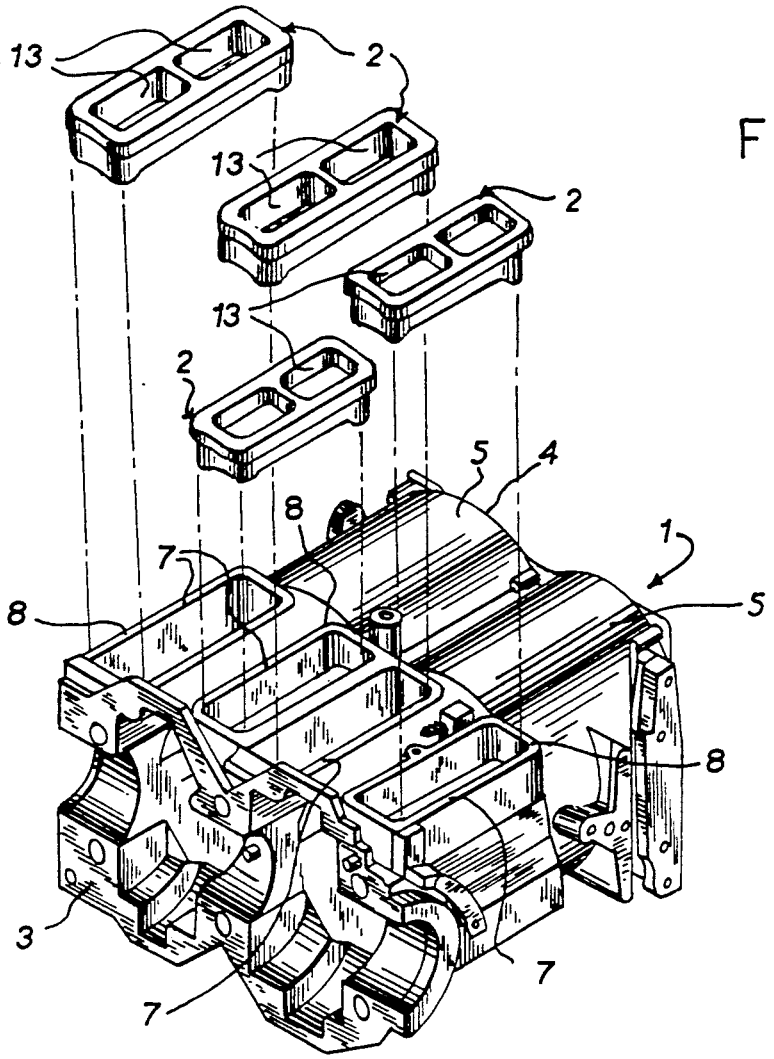
FIG. 1 is a perspective exploded view showing the evaporable foam pattern of the invention.

The invention relates to an evaporable foam pattern to be used in casting a metal block for a two-cycle engine, particularly a two-cycle, loop charge marine engine. The pattern includes a block section 1 and a plurality of port cover sections 2. The sections 1 and 2 are composed of a polymeric material, such as polystyrene or polymethylmethacrylate, which is capable of vaporizing when subjected to the heat of molten metal during casting.

Block section 1 includes a crankcase end 3 and a head end 4 and a pair of cylinders 5 extend between the crankcase end and the head end. Each cylinder 5 is bordered by a cylindrical internal wall 6. While the drawings illustrate the invention as applied to a pattern for casting a two-cylinder engine, it is contemplated that the engine can have other numbers of cylinders.

Block section 1 is formed with a plurality of elongated slots 7 corresponding to the number of transfer ports in the cast engine. In the typical engine, three transfer ports are associated with each cylinder 5 and thus with a two-cylinder engine there will be a total of six transfer ports and correspondingly six slots 7. In FIG. 1 only two slots 7 are visible for each cylinder with the third slot being located on the underside of the pattern section.

Figure 2:
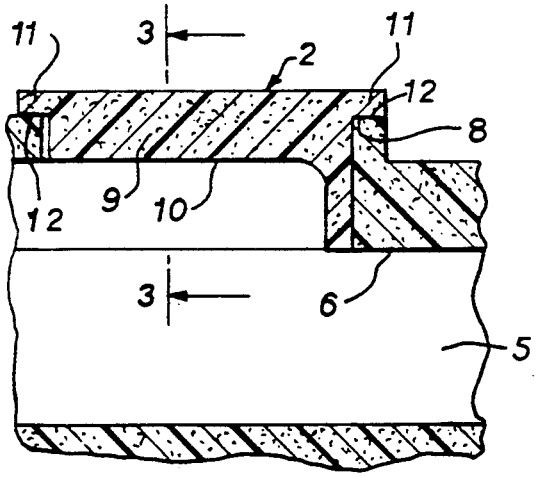
FIG. 2 is a fragmentary longitudinal section showing the attachment of a port cover section to the block section.
Figure 3:
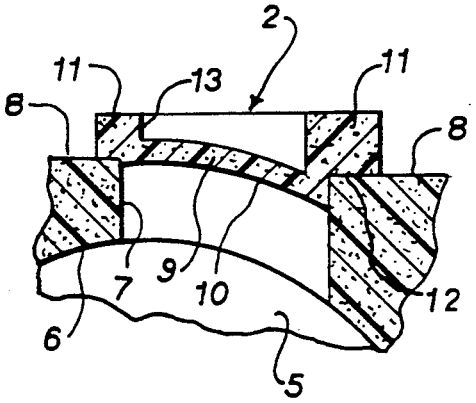
FIG. 3 is a section taken along line 3—3 of FIG. 2.

As shown in FIGS. 2 and 3, each slot 7 is bordered by a flat peripheral surface 8.

Each port cover section 2 includes an inner portion 9, which is received within the respective slot 7 and the inner surface 10 of section 2 defines the outer wall of the respective transfer port in the cast engine. Each section is also provided with a peripheral flange 11, which is disposed in abutting relation to the respective surface 8, as shown in FIGS. 2 and 3. The mating surfaces of 8 and 11 are joined together by an adhesive as commonly used in evaporable foam casting procedures. The adhesive is a type that will be vaporized when exposed to the heat of the molten metal with the vapor passing into the surrounding sand, so that no adhesive residue will be present in the metal casting.

The outer surface of each cover section 2 is provided with a pair of recesses 13, which act to reduce the weight of the cast metal block.

To assemble the pattern, the port cover sections 2 are inserted in the slot 7 of block section 1 and joined to the block section by a layer of adhesive 12 applied between the abutting surfaces 8 and 1l.

The assembled pattern is then subjected to a ceramic wash which will coat both the internal and external surfaces of the pattern. The assembled pattern is designed so that the ceramic wash will readily contact all the internal and external surfaces of the pattern and will drain therefrom.

The ceramic coated pattern is then placed in a mold and an unbonded, finely divided, flowable material, such as sand, is introduced into the mold, surrounding the pattern, as well as filling the cavities in the pattern.

A molten metal, such as aluminum alloy, is then fed via a sprue into contact with the pattern and the heat of the molten metal will vaporize the pattern, as well as the adhesive joints, with the vapor passing into the interstices of the sand, while the molten metal fills the void created by vaporization of the pattern. This results in a metal casting having a configuration identical to the evaporable foam pattern.

After casting, cylinder liners can then be inserted into the cylinders and the cylinder liners will define the inner wall of the transfer ports. In this regard, steel liners can either be press fitted into the cylinders, or cast in the cylinders.

The invention enables the port covers to be cast integrally with the block, thus eliminating the requirement for machining abutting surfaces, drilling and tapping holes, and gasketing, as required in an engine construction utilizing separate cast port covers.

Further, the weight of the engine is reduced. The need for increased section thicknesses to accommodate gasketing is eliminated, as well as eliminating the dead weight of connecting components, such as bolts, bosses, gaskets, and the like.

Various modes of carrying out the invention are contemplated as being within the scope of the following claims particularly pointing out and distinctly claiming the subject matter which is regarded as the invention.

We claim:

1. An evaporable foam pattern for use in casting a metal block for a two-cycle engine, comprising a first pattern section formed of an evaporable foam material and defining at least one cylinder, said first pattern section having a plurality of slots extending through the section and communicating with said cylinder, each slot being bordered by an outer surface, a second evaporable foam pattern section for each-slot, each second pattern section having a portion extending within the respective slot, each second pattern section having a peripheral flange abutting the surface bordering the respective slot, the inner surface of each second pattern section defining the outer wall of a transfer port, and means for joining the abutting surfaces together.

2. The pattern of claim 1, wherein said joining means comprises an adhesive.

3. The pattern of claim 1, wherein said foam material is polystyrene.

4. The pattern of claim 1, wherein said surfaces are planar.

5. The pattern of claim 1, wherein the inner surface of each second pattern section is spaced radially outward of the respective cylinder.

6. An evaporable foam pattern for use in casting a metal block for a two-cycle engine, comprising a block section formed of evaporable foam material and defining a plurality of cylinders, a plurality of elongated slots extending through said block section and communicating with each cylinder, each slot being bordered by an outer surface, a cover port pattern section for each slot, each cover port section being formed of an evaporable foam material and having a portion extending within the respective slot, each cover port section also including a peripheral flange disposed in abutting relation with the surface of the respective slot, the inner surface of each cover port pattern section defining the outer wall of a transfer port, and adhesive means for joining the abutting surfaces together.

7. The pattern of claim 6, wherein the slots are elongated in a direction parallel to the axis of the respective cylinder.

8. The pattern of claim 6, and including recess means disposed in the outer surface of each cover port pattern section.

9. An evaporable foam pattern for use in casting a metal block for a two-cycle engine, comprising a block section formed of evaporable foam material and defining a plurality of cylinders, each cylinder being bordered by a cylinder wall, a plurality of elongated slots extending through said block section and communicating with each cylinder, each slot being bordered by an outer surface, a cover port pattern section for each slot, each cover port section being formed of an evaporable foam material and having a portion extending within the respective slot, each cover port section also including a peripheral flange disposed in abutting relation with the surface of the respective slot, the inner surface of each cover port pattern section being spaced radially outward of the respective cylinder wall and defining the outer wall of a transfer port, and adhesive means for joining the abutting surfaces together.

10. The pattern of claim 9, wherein each slot is generally rectangular in shape and is elongated in a direction parallel to the axis of the respective cylinder.

* * * * *